US005952873A

United States Patent [19]

Rincon-Mora

[11] Patent Number: 5,952,873

[45] Date of Patent: Sep. 14, 1999

[54] LOW VOLTAGE, CURRENT-MODE, PIECEWISE-LINEAR CURVATURE CORRECTED BANDGAP REFERENCE

[75] Inventor: Gabriel A. Rincon-Mora, Allen, Tex.

[73] Assignee: Texas Instruments Incorporated, Dallas, Tex.

[21] Appl. No.: 09/056,593

[22] Filed: Apr. 7, 1998

Related U.S. Application Data

[60] Provisional application No. 60/042,959, Apr. 7, 1997.

[51] Int. Cl.[6] ..... G05F 1/10

[52] U.S. Cl. ..... 327/539; 327/513; 323/313; 323/315

[58] Field of Search ..... 327/512, 513, 327/378, 538, 539; 323/313, 314, 315

[56] References Cited

U.S. PATENT DOCUMENTS 4,897,595 1/1990 Holle ..... 323/314
5,325,045 6/1994 Sundby ..... 323/313
5,774,013 6/1998 Groe ..... 327/543
5,821,741 10/1998 Brokaw ..... 323/311

*Primary Examiner*—Timothy P. Callahan
*Assistant Examiner*—An T. Luu
*Attorney, Agent, or Firm*—W. James Brady, III; Richard L. Donaldson

[57] ABSTRACT

A bandgap circuit (16) for supplying a reference voltage includes a first current source ($AI_{Vbe}$) supplying a current proportional to a base-emitter voltage, a second current source ($BI_{PTAT}$) supplying a current proportional to absolute temperature, and a third current source ($CI_{NL}$) supplying a non-linear current. First (R3), second (R2), and third (R1) resistors are coupled in series between a first node (c) and ground. The first current source is coupled to the first node. The second current source is coupled to a second node (a) between the first and second resistors. The third current source is coupled to a third node (b) between the second and third resistors. An output coupled to the first node supplies the reference voltage Vref. The bandgap circuit provides a low voltage reference with temperature compensation flexibility.

2 Claims, 3 Drawing Sheets

LOW VOLTAGE, CURRENT-MODE, PIECEWISE-LINEAR CURVATURE CORRECTED BANDGAP REFERENCE

This application claims priority under 35 USC § 119(e) (1) of provisional application number 60/042,959 filed Apr. 7, 1997.

FIELD OF THE INVENTION

The invention relates generally to electronic systems and, more particularly, to a low voltage, current-mode, piecewise-linear curvature corrected bandgap reference.

BACKGROUND OF THE INVENTION

Reference circuits are necessarily present in many applications ranging from purely analog, mixed-mode, to purely digital circuits. The demand for low voltage references is especially apparent in mobile battery operated products, such as cellular phones, pagers, camera recorders, and laptops. Consequently, low voltage and low quiescent current flow are intrinsic and required characteristics conducive toward increased battery efficiency and longevity. Low voltage operation is also a consequence of process technology. This is because isolation barriers decrease as the component densities per unit area increase thereby exhibiting lower breakdown voltages. By the year 2004, the power supply voltage is expected to be as low as 0.9 V in 0.14 $\mu$m technologies. Unfortunately, lower dynamic range (a consequence of low voltage) demands that reference voltages be more accurate thereby necessitating curvature correcting schemes. Furthermore, financial considerations also require that these circuits be realized in relatively simple processes, such as standard CMOS, bipolar, and stripped down biCMOS technologies.

SUMMARY OF THE INVENTION

Generally, and in one form of the invention, a bandgap circuit for supplying a reference voltage, comprises: a first current source supplying a current proportional to a base-emitter voltage; a second current source supplying a current proportional to absolute temperature; a third current source supplying a non-linear current; first, second, and third resistors coupled in series between a first node and ground; the first current source coupled to the first node, the second current source coupled to a second node between the first and second resistors, the third current source coupled to a third node between the second and third resistors; and an output coupled to the first node supplying the reference voltage. The bandgap circuit provides a low voltage reference with temperature compensation flexibility.

DETAILED DESCRIPTION OF THE INVENTION

Figure 1A:
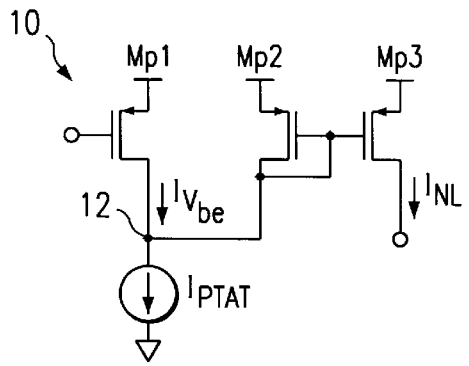
FIG. 1*a* shows a circuit for generating a nonlinear current component.
Figure 1B:
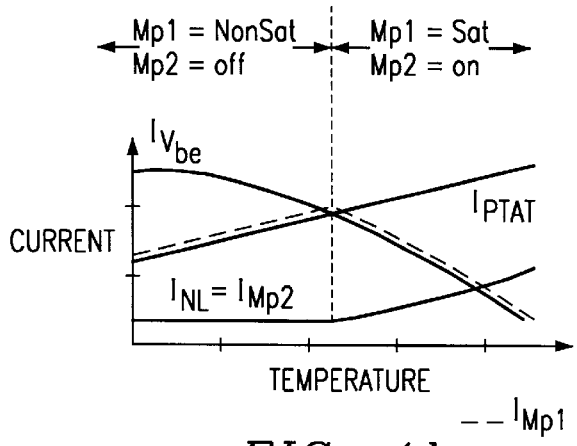
FIG. 1*b* is a graph showing the operation of the circuit of FIG. 1*a* throughout the temperature range.

Curvature correction is based on the addition of a nonlinear component to the output of a first order bandgap reference. This is used to offset the nonlinear behavior of $V_{be}$ with respect to temperature. In accordance with the present invention, the nonlinear component is realized by $I_{NL}$ in the current-mode topology of the circuit 10 in FIG. 1. Circuit 10 includes PMOS transistors Mp1, Mp2, and Mp3 and current source $I_{PTAT}$. Transistors Mp1 and Mp2 have source-drain paths coupled between a source of voltage V and node 12. Current $I_{Vbe}$ flows through the source-drain path of transistor Mp1. Transistor Mp3 has a source-drain path, coupled between voltage source V and node 14, through which current $I_{NL}$ flows. Transistors Mp2 and Mp3 are configured as a current mirror having gates coupled to node 12. Current source $I_{PTAT}$ is coupled between node 12 and ground. Nonlinear current $I_{NL}$ is essentially a current-mode piecewise-linear form of compensation. The operation of circuit 10 is based on current subtraction and the characteristics of non ideal transistors. FIG. 1(*b*) graphically illustrates the operation of circuit 10 throughout the temperature range. Transistor Mp1 acts like a non ideal current source of a current that is proportional to a base-emitter voltage. For the lower half of the temperature range, the PTAT current ($I_{PTAT}$) is less than the supplied $V_{be}$ dependent current ($I_{Vbe}$), if MP1 operates in saturation. As a result, Mp2 is off and Mp1 operates in the linear region and provides only $I_{PTAT}$. For the upper half of the temperature range, however, $I_{PTAT}$ becomes larger than $I_{Vbe}$. Consequently, Mp1 becomes saturated and only supplies $I_{Vbe}$ while Mp2 sources the current difference. The resulting current through Mp3 is nonlinear, off during the first half of the temperature range and on during the latter half. This behavior can be described by $$I_{NL} = \begin{cases} 0 & I_{V_{be}} \geq I_{PTAT} \\ K_1 I_{PTAT} - K_2 I_{V_{be}} & I_{V_{be}} < I_{PTAT} \end{cases}, \quad (1)$$

where $K_1$ and $K_2$ are constants defined by mirror ratios.

Figure 2A:
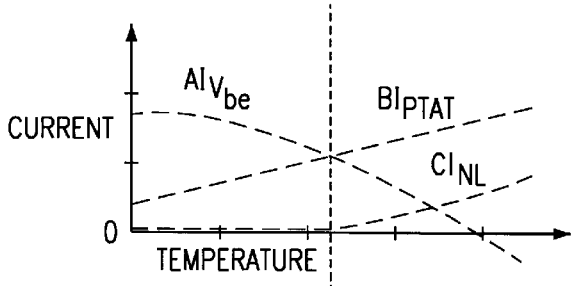
FIGS. 2*a* and 2*b* are graphs showing the temperature dependence of the curvature corrected bandgap reference circuit of the present invention.
Figure 2B:
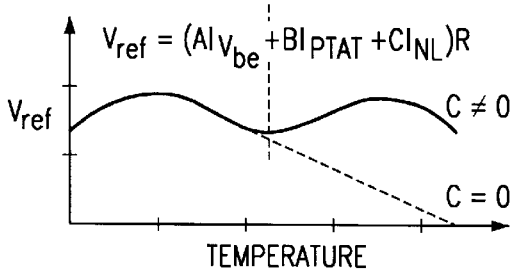

In accordance with the present invention, curvature correction is achieved by combining the three temperature dependent elements of FIG. 1(*b*) to yield an output voltage that is stable over temperature. This is done by partitioning the temperature range in two, the range for which the nonlinear current component $I_{NL}$ is (1) zero and (2) non-zero. As a result, the reference voltage ($V_{ref}$) can be temperature compensated to exhibit a behavior that is graphically described by FIG. 2(*a*) and (*b*). The lower temperature range is essentially a first order bandgap, since the nonlinear component ($I_{NL}$) is zero. At higher temperatures, the resulting behavior is similar to that of the lower temperatures but the operation is not. The nonlinear behavior of $I_{NL}$ ($K_1 I_{PTAT} - K_2 I_{Vbe}$) attempts to diminish the nonlinear term of $I_{Vbe}$. Consequently, the addition of currents $AI_{Vbe}$, $BI_{PTAT}$, and $CI_{NL}$, at the upper temperature range, generate a curvature corrected trace whose behavior is depicted by $V_{ref}$ in FIG. 2 (*b*).

Figure 3:
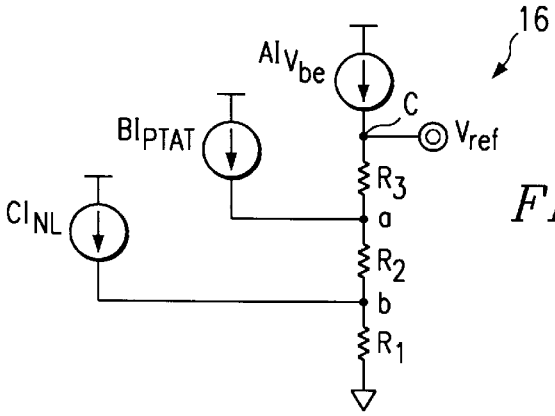
FIG. 3 shows a circuit having mixed current and voltage-mode architecture.

In accordance with the present invention, a current-mode approach is complemented with a voltage-mode ladder for improved versatility. FIG. 3 illustrates the implementation of a bandgap circuit 16 utilizing a current-mode approach with a voltage-mode ladder. Bandgap circuit 16 includes series connected current source $AI_{Vbe}$ and resistors R3, R2, and R1 coupled between a source of voltage V and ground. Bandgap reference voltage $V_{ref}$ is produced at node c between current source AIVbe and resistor R3. Current source $BI_{PTAT}$ is coupled between voltage source V and node a between resistors R3 and R2. Current source $CI_{NL}$ is coupled between voltage source V and node b between resistors R2 and R1. The current-mode approach offers the possibility of lower reference voltages, while the voltage-mode ladder gives greater temperature compensation maneuverability. The voltage ladder, in this case, is consistent with low voltage since the absolute voltage across all the resistors is small, i.e., 0.2–0.6 V across the complete ladder. Hence, a low voltage reference can be designed whose individual temperature components can be optimized during the trimming process. The resulting relation of the reference voltage ($V_{ref}$) can be described by $$V_{ref}=AI_{Vbe}[R_1+R_2+R_3]+BI_{PTAT}[R_1+R_2]+CI_{NL}R_1, \tag{2}$$

where $I_{Vbe}$, $I_{PTAT}$, and $I_{NL}$ correspond to the base-emitter, PTAT, and nonlinear temperature dependent currents respectively.

The topology illustrated in FIG. 3 offers greater temperature compensation flexibility than a strictly current or voltage mode topology. The output voltage as well as the temperature coefficients of the individual components can be trimmed by simply changing the resistor ratios at the output. Temperature compensation is achieved by trimming throughout the temperature range. Data points are collected for the voltages at $V_{ref}$, node "a," and node "b" throughout the temperature sweep. At this point, the currents multiplied by an initial reference resistor can be extrapolated since the voltage across each resistor and corresponding initial resistor ratios are known; thus, $$I_{V_{be}}R_{2_{initial}} = \frac{V_{ref}-V_a}{\left\langle\frac{R_3}{R_2}\right\rangle_{initial}}, \tag{3}$$

$$I_{PTAT}R_{2_{initial}} = (V_a-V_b)-I_{V_{be}}R_{2_{initial}}, \tag{4}$$

and $$I_{NL}R_{2_{initial}} = \frac{V_b}{\left\langle\frac{R_1}{R_2}\right\rangle_{initial}} - \langle V_a-V_b\rangle, \tag{5}$$

where $V_a$ and $V_b$ correspond to the voltages at nodes "a" and "b." These voltages exhibit temperature characteristics that are independent of the temperature coefficient of the resistors. This is because the currents are defined by resistors that are of equal type as those used in the output resistor ladder, i.e., $$\frac{\partial}{\partial T} = \langle AI_{V_{be}}\cdot R_{out}\rangle = \frac{\partial}{\partial T}\left\langle\frac{AV_{be}}{R(T)}\cdot R_{out}(T)\right\rangle \approx \frac{\partial}{\partial T}\langle AV_{be}\cdot \text{Constant}\rangle. \tag{6}$$

This is a first order approximation with resistors whose temperature characteristics track each other. Second order effects such as the effects of the resistor's temperature coefficient on $I_{PTAT}$ and $I_{Vbe}$ are neglected. Thus, the coefficients of each component can be extracted and manipulated to yield proper temperature compensation by means of a computer. Equation (2) can be adjusted to illustrate the appropriate temperature coefficients by using the values derived in equations (3) through (5), $$V_{ref}\frac{R_{2_{initial}}}{R_2} = AI_{V_{be}}\left\langle\frac{R_1}{R_2}+\frac{R_2}{R_2}+\frac{R_3}{R_2}\right\rangle R_{2_{initial}} + BI_{PTAT}\left\langle\frac{R_1}{R_2}+\frac{R_2}{R_2}\right\rangle R_{2_{initial}} + CI_{NL}\left\langle\frac{R_1}{R_2}\right\rangle R_{2_{initial}}, \tag{7}$$

or $$V_{ref}\frac{R_{2_{initial}}}{R_2} = C_1AI_{V_{be}}R_{2_{initial}} + C_2BI_{PTAT}R_{2_{initial}} + C_3CI_{NL}R_{2_{initial}} \tag{8}$$

where $C_1$, $C_2$, and $C_3$ are the extracted coefficients. Once values for these coefficients are obtained, new resistor ratios for $R_1/R_2$ and $R_3/R_2$ can be derived.

The next and final step in the trimming procedure is to adjust the magnitude of the output voltage at room temperature or whatever temperature is desired. This can be accomplished by changing the ratio of the initial to the final value of $R_2$ ($R_{2initial}/R_2$). The ratio is determined by using the resistor ratios previously derived and the voltages obtained at room temperature ($V_{ref}$, $AI_{Vbe}R_{2initial}$, $BI_{PTAT}R_{2initial}$, and $CI_{NL}R_{2initial}$) in equations (7) and (8) and solving for $R_{2initial}/R_2$. It is noted that knowledge of the absolute value of the resistors is not necessary. Instead, the intrinsic parameters that require control are the ratios of the resistors.

The cost of implementing this algorithm to trim the circuit over a specified temperature range can be reduced by trimming only for the absolute value at room temperature and relying on simulations for proper temperature compensation.

Figure 4:
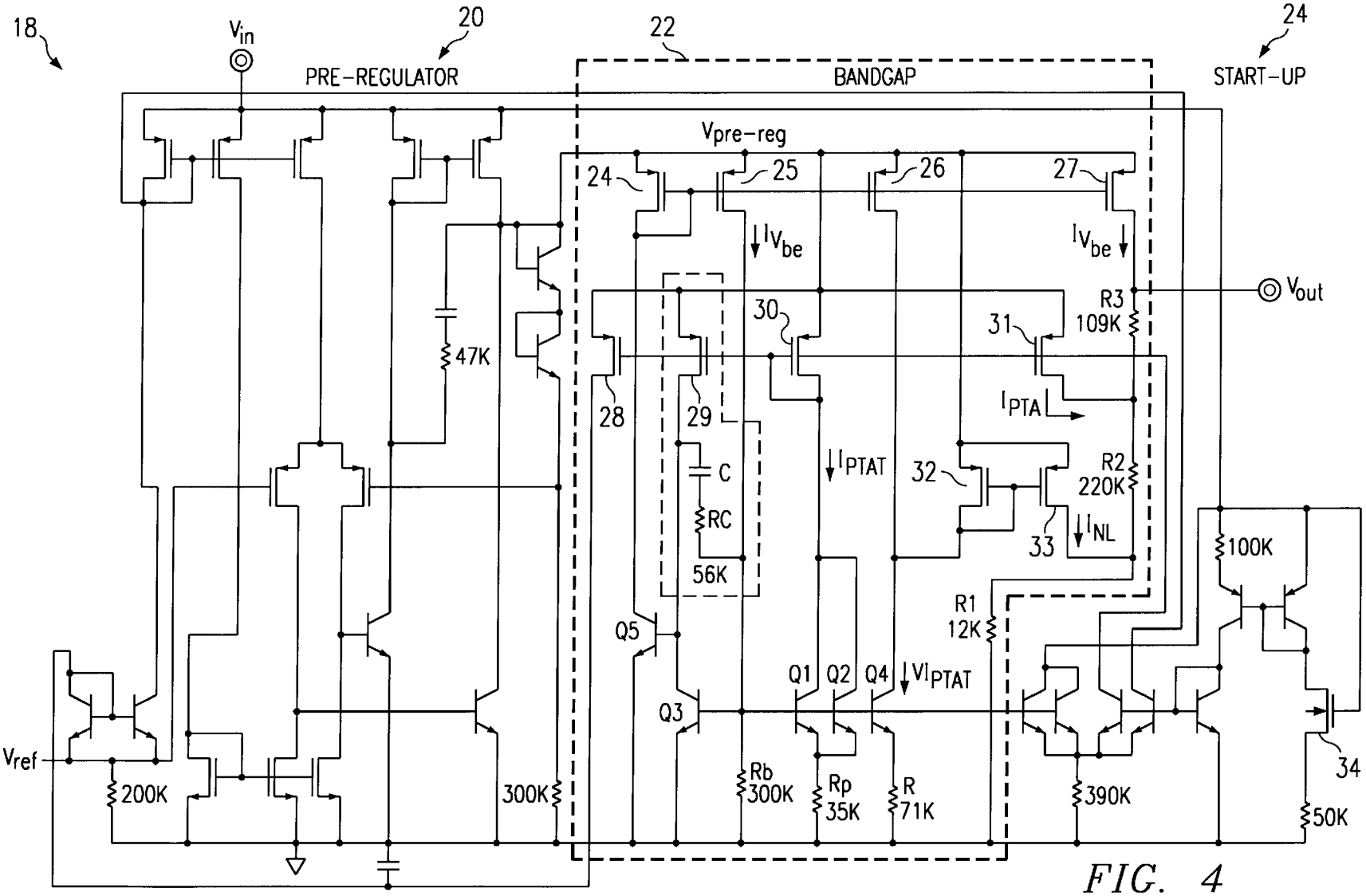
FIG. 4 shows a low voltage curvature corrected bandgap circuit according to the present invention.

FIG. 4 shows a circuit 18 implementing in detail the bandgap circuit of FIG. 3. Circuit 18 includes a pre-regulator circuit 20, bandgap circuit 22, and start-up circuit 24. Pre-regulator circuit 20 supplies a regulated input voltage ($V_{pre\text{-}reg}$) to bandgap circuit 22. Bandgap circuit 22 includes a first current mirror made up of PMOS transistors 24–27 and a second current mirror made up of transistors 28–31.

The proportional-to-absolute temperature (PTAT) current $I_{PTAT}$ is realized by NPN transistors Q1, Q2, Q3, and resistor Rp, which constitute a Vbe loop. The base-emitter dependent current $I_{Vbe}$ is defined by the base-emitter voltage of Q3 and Rb. A negative feedback loop made up of NPN transistors Q3 and Q5 and the current mirror formed by PMOS transistors 24 and 25 provide control of the base-emitter dependent current. Capacitor Cc and resistor Rc frequency compensate the feedback loop to provide stability. The nonlinear temperature dependent current $I_{NL}$ is formed by Q4 (PTAT current sink), PMOS transistor 26 (IVbe current source), PMOS transistors 32 and 33, which implement current subtraction as discussed above with respect to FIG. 1. Bandgap reference voltage Vref is produced at the node between transistor 37 and resistor R3.

The circuit has been fabricated in the MOSIS 2 $\mu$m n-well CMOS technology with an added p-base layer. The pre-regulated voltage ($V_{pre\text{-}reg}$) stays approximately constant at $2V_{be}$ for input voltages ($V_{in}$) greater than 1.25–1.3 V. When $V_{in}$ falls below this point, the regulator goes into drop-out ($V_{pre\text{-}reg}\approx V_{in}-r_{sd\text{-}on}I_{quiescent}$). Large resistors are necessary and consistent with micro-power design methodologies where quiescent current flow is kept under 20 $\mu$A. The resistors can be significantly reduced by allowing more quiescent current to flow. The passive components and the JFET 34 were implemented discretely to enhance testability of the concept. All the resistors can be made of any material as long as they are all the same type. Base-diffusion resistors are recommended because of their high sheet resistivities and their ability to be isolated from the substrate by a well. The capacitors can be stacked to minimize area, i.e., poly 2, poly 1, and base-diffusion capacitors with poly 1 as one terminal and poly 2/base-diffusion as the other. The well insulating the capacitor and the resistors can be connected to $V_{pre\text{-}reg}$ for minimized line regulation effects. The p-channel JFET can be implemented with a long base as the channel, n+ diffusion as the top gate, and n-well as the bottom gate. The purpose of the JFET 34 is to provide some current for the start-up circuit to work, i.e., 0.5–5 μA.

The minimum input voltage of the circuit is defined by a source-to-gate voltage and two saturation voltages. In particular, the input voltage is limited by $$V_{in} \geqq V_{ce\text{-}sat} + V_{sg} + V_{sd\text{-}sat}, \tag{9}$$

which can be approximately 1.1 V under weak-to-moderate inversion in the MOSIS technology. The circuit is biased in this region to minimize quiescent current flow and the effects of threshold voltages on the minimum input voltage. This minimum voltage is expected to be approximately 0.95–1 V in a process where a buried layer is offered. The buried layer reduces the NPN collector series resistance thereby decreasing the NPN saturation voltage ($V_{ce\text{-}sat}$) from approximately 300 to 150–200 mV.

Figure 5:
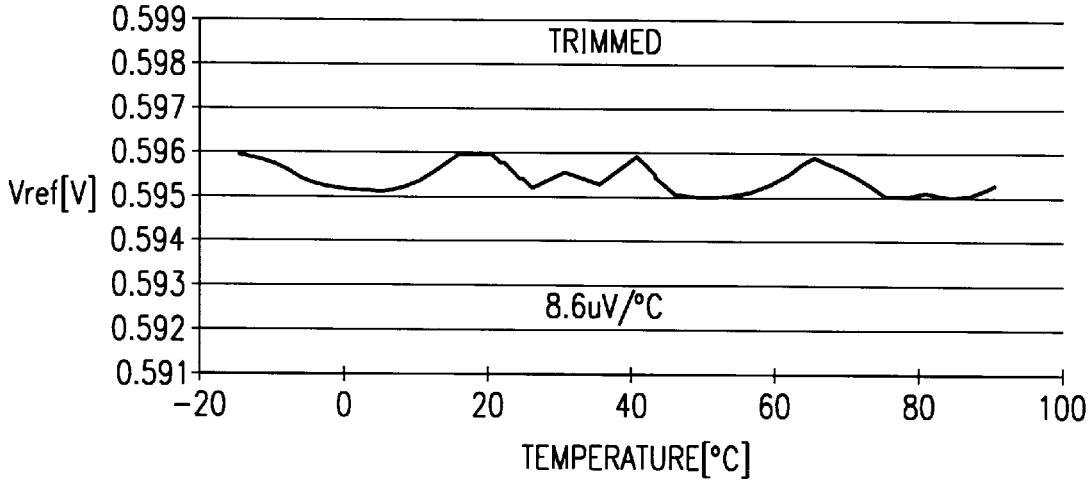
FIG. 5 is a graph showing the temperature dependence of the bandgap circuit of FIG. 4.
Figure 6:
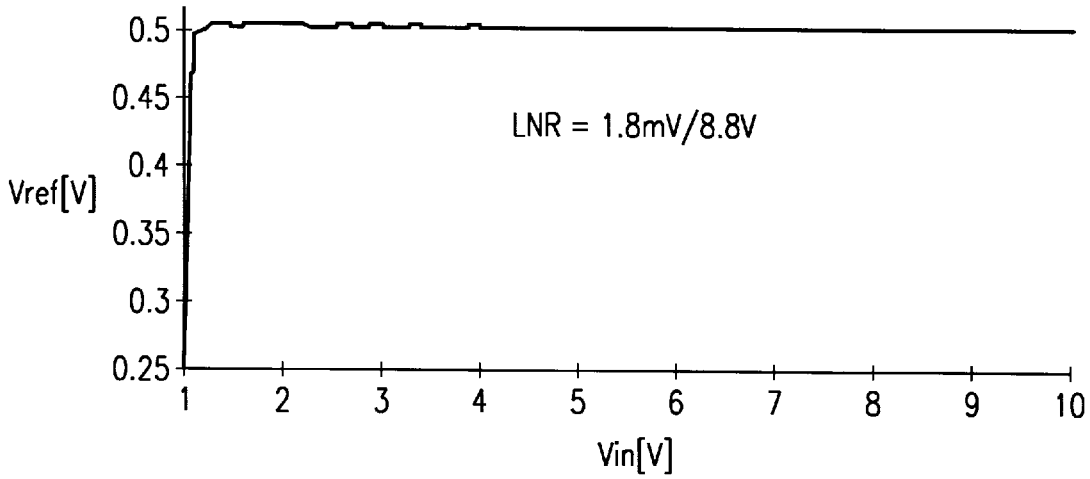
FIG. 6 is a graph showing line regulation performance of the bandgap circuit of FIG. 4.

The curvature corrected bandgap of FIG. 4 has a temperature dependence as illustrated in FIG. 5. It achieved a temperature drift of 8.6 μV/°C. (−15 to 90° C.). The trimming algorithm included the algorithm described earlier. The circuit achieved a line regulation performance of 204 and 1000 μV/V for $1.2 \leqq V_{in} \leqq 10$ V and $1.1 \leqq V_{in} \leqq 10$ V respectively, as shown in FIG. 6, with a maximum quiescent current flow of 14 μA (excluding the JFET's current). The circuit operated properly at a minimum power supply voltage of 1.1 V. The temperature dependence and the line regulation of the output simulated to be 3.9 μV/°C. and 72 μV/V respectively. The measured temperature performance could have been closer to the simulated value were it not for the parasitic effects of the start-up circuit. Leakage current out of the start-up circuit directly affects the output PTAT current component causing changes in the output voltage. A summary of the results is shown in Table 1.

A low voltage, micro-power curvature corrected bandgap circuit has been fabricated in a relatively inexpensive process, MOSIS CMOS 2 μm n-well technology with an added p-base layer. The p-base layer is used to create NPNs; however, a vanilla CMOS version can be designed by using lateral PNPs and/or parasitic diodes available in the process to generate $I_{Vbe}$ and $I_{PTAT}$. The circuit implements a novel current-mode piecewise-linear curvature correction technique. The prototype circuit achieved a temperature variation of 8.6 μV/°C. (−15 to 90° C.) with a line regulation performance of 204 μV/V ($1.2 \leqq V_{in} \leqq 10$ V) at a maximum quiescent current flow of 14 μA. The novel curvature correcting scheme utilized can be used in almost any process technology yielding reliable temperature compensation. The additional circuitry required for curvature correction is compact and easily implemented. The architecture also lends itself for versatile trimming procedures. The resulting circuit is compatible with low quiescent current flow and low voltage operation, which is especially important in a market where demand is growing for battery powered electronics requiring increasing efficiency and longevity.

TABLE 1

Performance summary.

| | Simulated Results | Measured Results |
|---|---|---|
| TC | 3.9 μV/° C. | 8.6 μV/° C. |
| Line Regulation (1.2 ≦ Vin ≦ 10V) | 72 μV/V | 204 μV/V |
| Quiescent Current | 15 μA | 14 μA |
| Minimum Input Voltage | 1.1 V | 1.1 V |
| Active Chip Area (no resistors or capacitors) | 798 μm × 280 μm | |
| MOSIS 2 μm n-well technology with added p-base layer ($V_t \approx 0.9$ V) | | |

What is claimed is:

1. A bandgap circuit for supplying a reference voltage, comprising:

a first current source supplying a current proportional to a base-emitter voltage therein;

a second current source supplying a current proportional to absolute temperature;

a third current source supplying a non-linear current;

first, second, and third resistors coupled in series between a first node and ground;

said first current source coupled to said first node, said second current source coupled to a second node between said first and second resistors, said third current source coupled to a third node between said second and third resistors; and an output coupled to said first node supplying the reference voltage.

2. The bandgap circuit of claim 1, in which said third current source includes:

a first transistor having a current path for supplying another current proportional to a base-emitter voltage to a fourth node;

a fourth current source supplying a current proportional to absolute temperature coupled between said fourth node and ground;

second and third transistors coupled as a current mirror, said second transistor having a current path coupled to said fourth node, said third transistor supplying said non-linear current.

* * * * *